US010770282B1

(12) United States Patent
Abramenko et al.

(10) Patent No.: US 10,770,282 B1
(45) Date of Patent: Sep. 8, 2020

(54) LASER-PUMPED PLASMA LIGHT SOURCE AND PLASMA IGNITION METHOD

(71) Applicant: RnD-ISAN, Ltd, Troitsk, Moscow (RU)

(72) Inventors: Dmitry Borisovich Abramenko, Moscow (RU); Robert Rafilevich Gayasov, Moscow (RU); Yurii Borisovich Kiryukhin, Moscow (RU); Vladimir Mikhailovich Krivtsun, Moscow (RU); Aleksandr Andreevich Lash, Moscow (RU)

(73) Assignee: RnD-ISAN, Ltd, Troitsk, Moscow (RU)

( * ) Notice: Subject to any disclaimer, the term of this patent is extended or adjusted under 35 U.S.C. 154(b) by 0 days.

(21) Appl. No.: 16/814,317

(22) Filed: Mar. 10, 2020

(51) Int. Cl.
*H01J 61/54* (2006.01)
*H01J 61/30* (2006.01)
*H01J 61/02* (2006.01)

(52) U.S. Cl.
CPC ..... *H01J 61/541* (2013.01); *H01J 61/025* (2013.01); *H01J 61/30* (2013.01)

(58) Field of Classification Search
CPC ..... H01J 61/541; H01J 61/025; H01J 61/30
See application file for complete search history.

(56) References Cited

U.S. PATENT DOCUMENTS

2016/0381776 A1* 12/2016 Derstine ..... H05H 1/24 250/503.1
2017/0278694 A1* 9/2017 Chuang ..... H01J 61/54
2018/0233878 A1* 8/2018 Leonardo ..... H01S 3/302

* cited by examiner

*Primary Examiner* — Anne M Hines
(74) *Attorney, Agent, or Firm* — Nadya Reingand; Yan Hankin

(57) ABSTRACT

The light source contains a gas filled chamber with a region of radiating plasma sustained by a focused beam of a CW laser. The means for plasma ignition is a pulsed laser system generating a first and a second laser beams focused in the chamber. The first laser beam provides the optical breakdown, after which the second laser beam ignites the plasma, whose volume and density are sufficient for stationary plasma sustenance by CW laser after finishing the second laser pulse. Preferably, the first laser beam is generated in Q-switching mode and the second laser beam is generated in free-running mode. The technical result consists in ensuring high reliability of igniting the plasma, in creating in this basis electrodeless high-brightness broadband light sources with the high spatial and power stability, and in providing an ability to collect broadband plasma radiation in a spatial angle of more than 9 sr.

22 Claims, 5 Drawing Sheets

LASER-PUMPED PLASMA LIGHT SOURCE AND PLASMA IGNITION METHOD

CROSS-REFERENCE TO RELATED APPLICATIONS

Current patent application claims priority to the Russian patent application RU 2020109782 filed on Mar. 5, 2020.

FIELD OF INVENTION

The present invention relates to electrodless laser-pumped plasma light sources producing high-brightness light in the ultra-violet (UV), visible and near infrared (NIR) spectral bands and to methods for starting plasma ignition.

BACKGROUND OF INVENTION

Continuous optical discharge (COD) is a stationary gas discharge sustained by laser radiation in pre-created relatively dense plasma. A COD, sustained by a focused beam of a continuous wave (CW) laser, is realized in various gases, in particular, in Xe at a high gas pressure of 10-200 atm (Carlhoff et al., "Continuous Optical Discharges at Very High Pressure," Physica 103C, 1981, pp. 439-447). Due to a high plasma temperature of about 20,000 K (Raizer, "Optical Discharges," Sov. Phys. Usp. 23 (11), November 1980, pp. 789-806) COD-based light sources are among the highest brightness continuous light sources in a wide spectral range between about 0.1 μm and 1 μm. Compared to arc lamps, such laser-pumped plasma light sources not only have a higher brightness, but also a longer lifetime, making them preferable for a variety of applications.

One of the challenges related to designing high-brightness laser-pumped plasma light sources, relates to producing initial plasma that provides reliable ignition of the COD.

As known, for example, from the U.S. Pat. No. 9,368,337, issued on Jun. 14, 2016, in laser-pumped plasma light source two pin electrodes, located on the axis of a transparent chamber, between which an arc discharge is generated for a short time, are used for starting plasma ignition. The beam of CW laser is focused in the chamber center, in the gap between the two electrodes. The source is characterized by high brightness and ease of use. The latter is largely due to the fact that quartz chambers or bulbs with two electrodes, containing gas, in particular, high-pressure Xe (10 atm or higher), are commercially available products.

However, the relatively cold electrodes located near the high-temperature plasma region produce disturbances of convective gas flows in the chamber and, as a result, impair spatial and energetic stability of the laser-pumped plasma light source. Besides, the presence of electrodes near the radiating plasma region is characterized by "dead" spatial angles restricting the exit of plasma radiation. Also, electrode material sputtering may result in decreased transparency of the bulb walls and, correspondingly, to the light source degradation over time.

This drawback is largely overcome in the high-brightness broadband light source known from the U.S. Pat. No. 9,357,627, issued on May 31, 2016. In its embodiment, after COD ignition the laser beam focus area and, correspondingly, the radiating plasma region, are moved from the gap between the igniting electrodes towards the chamber wall. By choosing the relative position of the laser beam, chamber axis and radiating plasma region, a high spatial and power stability of the broadband laser-pumped plasma light source is provided.

However, the need to move the radiating plasma region complicates the light source design and operation. Besides, it makes using the sharp focusing of the laser beam more difficult, which may limit achievement of the high brightness of the light source. The disadvantages of an electrode-containing chamber also include the complex technology for sealing the metal/glass joint and the complex chamber shape producing a concentration of stresses which result in lower strength of the chamber when operating at high gas pressures.

The above-mentioned disadvantages are absent in the electrode-free laser-pumped plasma light source known from the patent application JPS 61193358 issued on Aug. 27, 1986, where the laser is used both for starting plasma ignition and for COD sustenance.

However, the threshold power of laser radiation required for plasma ignition is usually from about ten to several hundreds of kilowatts or higher, while the laser radiation intensity sufficient for COD sustenance is typically just a few tens of Watts. Thus, using the same laser with a high output power both for plasma ignition and COD sustenance either results in reduced lifetime of the light source (when the full laser power is used for COD sustenance), or is redundant, expensive and, therefore, impractical if only a fraction of the full laser power is used to sustain the COD.

U.S. Pat. No. 10,057,973, issued on Aug. 21, 2018, proposes to overcome this challenge by using a single CW laser with the power of less than 250 Watts and a wavelength of less than 1.1 μm. It is suggested that COD ignition and sustenance is provided by means of sharp focusing of CW laser beam with a focal area cross size of less than 1-15 microns, and a focal area length of 6 microns or lower.

However, this solution is not versatile, since the requirements to laser focusing are very high and do not guarantee high functional reliability of the proposed light source. Besides, the laser power of around 250 Watts supplied to the light source may be too high for a variety of applications.

These disadvantages are overcome in the light source known from patent FR2554302 issued on May 3, 1985, where a focused pulsed laser beam intended for initial plasma ignition or optical breakdown is used as a means for plasma ignition and a CW laser is used for COD sustenance. The above-mentioned approach eliminates the problem of the laser-pumped plasma light source lifetime.

However, sharp focusing of laser beams is required for both plasma ignition and ensuring high brightness of laser-pumped plasma light source. Thus, an extremely precise adjustment is needed of the pulsed and CW laser focusing areas. This results in a complexity and poor reliability of laser ignition, making stable COD ignition in a high-brightness light source problematic.

These disadvantages are partially overcome in the light source known from the U.S. Pat. No. 10,244,613, issued on May 25, 2017. In an embodiment of the invention the beams of one or several igniting lasers and beams of one or several CW lasers, intended for COD sustenance, are introduced into an optical fiber used for delivering the radiation of the said lasers to a condensing or focusing optical system. In the said device, superposition of the focusing areas of the pulsed lasers and of CW lasers is achieved, if the wavelengths of the said lasers are similar.

However, if the pulsed and CW laser wavelengths are different, their focusing areas diverge due to chromatic aberrations. Besides, transmitting laser pulses with the high power used for reliable COD ignition (hundreds of kW) through an optical fiber may result in optical fiber destruction, which determines the disadvantages of this solution.

SUMMARY

The technical problem to be solved by the invention relates to the creation of methods and devices for highly reliable laser ignition of continuous optical discharge and to develop high-brightness highly-stable laser-pumped plasma light sources on the basis thereof.

The technical result of the invention consists in ensuring high reliability of igniting the plasma sustained by a CW laser, and in creating electrode-free high-brightness broadband light sources with the high spatial and power stability on that basis.

Achievement of the purpose is possible by means of the proposed laser-pumped plasma light source, comprising: a high-pressure gas filled chamber, at least a part of which is optically transparent; a region of radiating plasma sustained in the chamber by a focused beam of a continuous wave (CW) laser; at least one output beam of plasma radiation exiting the chamber, and a means for plasma ignition.

The light source is characterized in that the means for plasma ignition is a pulsed laser system generating a first and a second laser beams focused in the chamber, whereas said first laser beam is arranged for gas optical breakdown, and said second laser beam is arranged for plasma ignition after optical breakdown.

In an embodiment of the invention, the first laser beam has a peak radiation power of more than $10^4$ Watts and a pulse length of less than 0.1 microseconds.

In an embodiment of the invention, the second laser beam has at least three times more laser pulse energy and at least an order of magnitude lower laser peak power compared to the first laser beam.

In a preferred embodiment of the invention, the volume of the plasma ignited by the second laser beam many times, by an order of magnitude or more, exceeds the volume of the plasma created during optical breakdown by the first laser.

In a preferred embodiment of the invention, the volume and density of the plasma ignited by the second laser beam are sufficient for stationary sustenance of the plasma by the focused beam of the CW laser.

In an embodiment of the invention, the second laser beam provides a plasma size of up to approximately 1 mm (FWHM of free electron density), and a plasma density of up to 1018 cm-3 $10^{18}$ $cm^{-3}$ or more (measured as free electrons per volume).

In an embodiment of the invention, the output power of the CW laser does not exceed 300 Watts.

In an embodiment of the invention, the radiation pulse of the second laser beam ends no earlier than 50 μs after the end of the radiation pulse of the first laser beam.

In a preferred embodiment of the invention, the focusing areas of the first and the second laser beams at least partially overlap or are superposed.

In a preferred embodiment of the invention, the pulsed laser system comprises two lasers with common cavity mirrors, the first and the second laser beams are parallel and are introduced into the chamber through one common focusing optical system.

In a preferred embodiment of the invention, the pulsed laser system is a solid-state laser system.

In a preferred embodiment of the invention, the pulsed laser system generates the first laser beam in Q-switching mode or in giant-pulse generation mode.

In a preferred embodiment of the invention, the pulsed laser system generates the second laser beam in free running mode.

In a preferred embodiment of the invention, only the CW laser has a fiber-optic output.

In an embodiment of the invention, the wavelength of the CW laser is different from the wavelengths of radiation of the first and the second laser beams.

In a preferred embodiment of the invention, the focused beam of the CW laser is directed vertically upwards or close to vertical.

In an embodiment of the invention, the external surface and the internal surface of the chamber's transparent parts are shaped as concentric spheres or parts thereof, and the region of radiating plasma is located in the center of the said concentric spheres.

In a preferred embodiment of the invention, the useful beam of plasma radiation exits the chamber in all azimuths.

In an embodiment of the invention, the output beam of plasma radiation exits the chamber in a solid angle of not less than 9 sr.

In an embodiment of the invention, the laser-pumped plasma light source has three or more output beams of plasma radiation.

In another aspect, the invention relates to a method for igniting plasma in the laser-pumped plasma light source comprising: direction of a focused beam of a CW laser into a chamber with high-pressure gas, starting plasma ignition and stationary sustenance of a radiating plasma by the focused beam of the CW laser.

The method is characterized in that the plasma ignition is provided by a pulsed laser system generating a first and a second laser beams focused in the chamber, whereas the first laser beam is used to provide an optical breakdown, after which the second laser beam is used to ignite a plasma, whose volume and density are sufficient for stationary plasma sustenance by the focused beam of the CW laser.

In a preferred embodiment of the invention, the pulsed laser system is a solid-state laser system which generates the first laser beam in Q-switching mode and generates the second laser beam in free-running mode.

Designing the light source in the proposed way allows achieving the reliable ignition of the COD by choosing the appropriate energy, duration and pulse power of the first and the second laser beams due to the following factors. A reliable optical breakdown is provided by the first laser beam. However, COD ignition using only one laser beam is unstable and problematic. One of the reasons is the difficulty of superposing the CW laser focusing area with the optical breakdown area, the size of which is normally very small and does not exceed the value of around 50 μm. Even if the focusing areas of the pulsed and CW laser beams are superosed, COD ignition using only one laser beam still remains challenging. This is due to the fact that optical breakdown generated by laser radiation has an explosive character. Explosive processes, in particular, shock waves, may result in suppression of the optical discharge sustained by a CW laser with a low power which is typically not more than 300 Watts. According to the invention, this problem is solved by using the second pulsed laser beam to provide plasma ignition after an optical breakdown. In this case, the pulsed optical discharge sustained by the second laser beam, is itself free of explosive phenomena, and the plasma ignited by the second laser beam, is resistant to disturbances caused by the optical breakdown. At the same time, the second laser beam ensures a plasma volume and density sufficient for reliable stationary plasma sustenance by a focused beam of a CW laser with a relatively small output power. This way a reliable COD ignition is achieved.

The advantages and features of the present invention will become more apparent from the following non-limiting description of exemplary embodiments thereof, given by way of example with reference to the accompanying drawings.

BRIEF DESCRIPTION OF DRAWINGS

The essence of the invention is explained by the drawings, in which.

In the drawings, the matching elements of the device have the same reference numbers.

These drawings do not cover and, moreover, do not limit the entire scope of options for implementing this technical solution, but are only illustrative examples of particular cases of its implementation

DETAILED DESCRIPTION OF THE PREFERRED EMBODIMENTS

This description is provided to illustrate how the invention can be implemented and in no way to demonstrate the scope of this invention.

Figure 1:
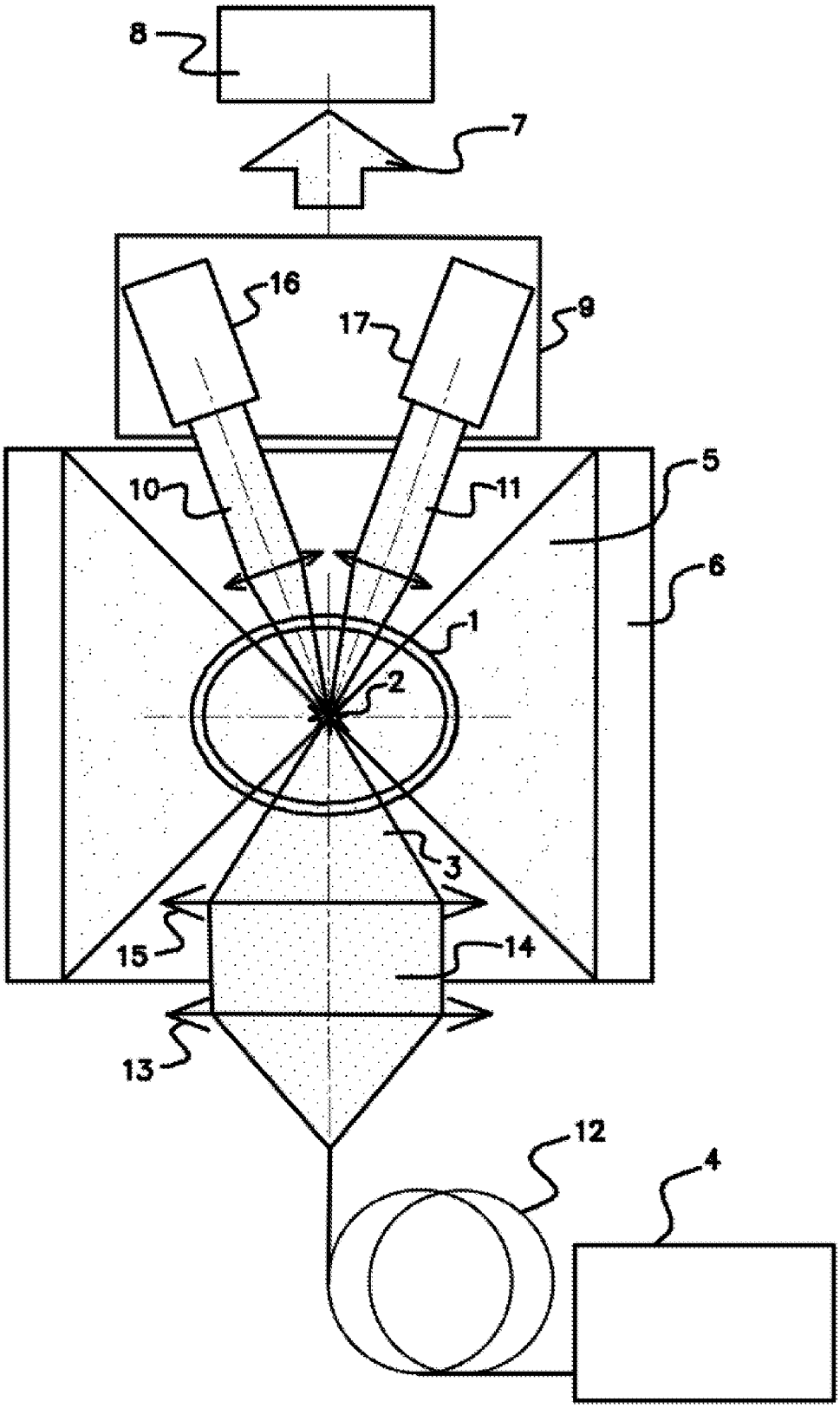
FIG. 1—Schematic diagram of laser-pumped plasma light source with the pulsed laser system for plasma ignition in accordance to the present invention, FIG. 2—Diagram of radiation power of laser beams according to the embodiment of invention, FIG. 3—Schematic of laser-pumped plasma light source with the solid-state laser system for plasma ignition, FIG. 4—Schematic view of the light source with the three-channel output of output plasma radiation, FIG. 5—Diagram of radiation power of laser beams according to one of the embodiments of the invention.

According to the example of invention embodiment shown in FIG. 1, the laser-pumped plasma light source comprises the high-pressure gas filled chamber 1, typically 10 atm or higher. At least a part of the chamber 1 is optically transparent. FIG. 1 shows an embodiment with a completely transparent chamber manufactured from an optically transparent material, e.g. fused quartz. The chamber 1 contains the radiating plasma region 2 sustained in the chamber by the focused beam 3 of the CW laser 4. At least one output beam of plasma radiation 5 directed to the optical collector 6 and intended for subsequent use, exits the chamber 1. The optical collector 6 forms the radiation beam 7 transmitted, for example, via an optical fiber and/or a system of mirrors to one or more optical consumer systems 8 which uses broadband radiation emitted by plasma.

Optical collectors are described in more detail, for example, in the U.S. Pat. No. 9,357,627, published May 31, 2016 which is incorporated by reference herein in the entirety.

The light source also comprises a means for plasma ignition The light source is characterized in that the means for plasma ignition is a pulsed laser system 9 generating the first laser beam 10 and the second laser beam 11 focused in the chamber 1, namely into the region intended for sustaining the radiating plasma 2. The first laser beam 10 is intended for starting plasma ignition or for optical breakdown in the chamber 1. The second laser beam 11 is intended for plasma ignition after an optical breakdown provided by the first laser beam 10.

Designing the light source in the proposed way allows to achieve reliable ignition of the continuous optical discharge by choosing the appropriate energy, duration and, correspondingly, pulse power of the two laser beams. This allows to create electrodless high-brightness broadband laser-pumped plasma light sources characterized by the highest possible spatial and energetic stability.

Absence of electrodes simplifies the high-pressure chamber design, improves the chamber strength and reliability, and in preferred embodiments of invention ensures that the output beam 5 of plasma radiation exits the chamber in the planar angle of 360° or in all azimuths, FIG. 1. This means that in the azimuthal plane perpendicular to the axis of the beam 3 of the CW laser and passing through the region of the radiating plasma 2, the output beam of plasma radiation exits the chamber in all azimuths from 0° to 360°. Furthermore, in preferred embodiments of the invention, the opening angle of the output beam 5 of plasma radiation (flat angle with respect to the plane of the drawing in FIG. 1) is not less than 90° and correspondingly, the plasma radiation is collecting by the optical collector 6 in a solid angle of 9 sr or more. Preferably, a cost-effective near-infrared diode laser with a fiber-optic output is used as the CW laser 4. In this case, at the exit of the optical fiber 12, the expanding laser beam is directed to the collimator 13, for example, in the form of a collecting lens. After the collimator 13 the expanded parallel beam 14 of the CW laser is directed to the focusing optical element 15, for example, in the form of an aspherical condenser lens. The focusing optical element 15 ensures sharp focusing of the beam 3 of the CW laser 4 required to achieve a high brightness of the light source.

In embodiments of the invention, the power of the CW laser 4 does not exceed 300 Watts, which is quite enough for a broad range of applications, but is not sufficient for igniting the continuous optical discharge without special means for plasma ignition.

In the embodiment of invention, the pulsed laser system 9 comprises the first laser 16 for generating the first laser beam 10, and the second laser 17 for generating the second laser beam 11, FIG. 1. Optical elements, for example, in the form of condenser lenses, may be used to focus the first and the second laser beams, without restriction to this option only.

In preferred embodiments of the invention the focusing areas of the first and the second laser beams are at least partially superposed or overlap.

Figure 2:
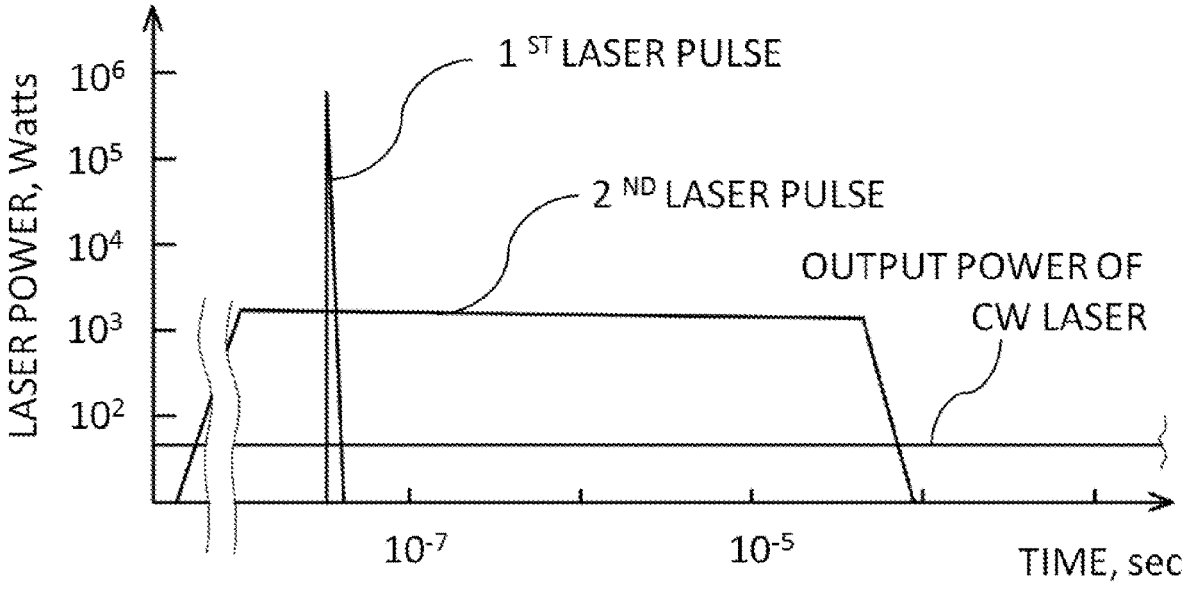

Characteristic time dependencies of the radiation power in the first and the second laser beams 10, 11, as well as in the beam of the CW laser 4, are schematically shown on the logarithmic scale in FIG. 2.

Preferably, to ensure reliable starting plasma ignition or optical breakdown, the first laser beam 10 is characterized by a high (at least $10^4$ W) pulse radiation power. In this case it is sufficient that the laser pulse full width at half maximum does not exceed 0.1 μs.

According to the invention, the second laser beam has many times lower pulse power, for example, $10^3$ Watts, and many times higher laser pulse length and energy, as compared to the first laser beam. This allows, after exposure to the first laser beam, use the second laser beam to create a volume of plasma which is many times, by an order of magnitude or more, larger than the volume of plasma produced by the first laser beam. At the same time, radiation power in the second laser beam is more than by an order of magnitude higher than the CW laser power, FIG. 2.

The second laser beam is intended for creating plasma, the volume and density of which are sufficient for stationary plasma sustenance by the focused beam of the CW laser.

In embodiments of the invention, the generating of the second laser beam begins before the generating of the first laser beam and ends not earlier than 50 μs after the end of the first laser pulse, FIG. 2. On the one hand, it makes synchronizing the first and second laser beams easier, on the other hand, it provides sufficient time for plasma evolution under the influence of the second laser beam. As a result, a large plasma volume of up to around 1 mm, and a plasma density of up to $10^{18}$ $cm^{-3}$, are provided, which are sufficient for reliable stationary plasma sustenance by the focused CW laser beam. A plasma density of $10^{18}$ $cm^{-3}$ corresponds to a gas with a temperature of 18,000 K and 10% ionization in the region of radiating plasma at initial gas pressure in the chamber of about 16 atm.

In one of its embodiments, the laser-pumped plasma light source operates as follows. The focused beam 3 of the CW laser 4 is directed into the at least partially transparent high-pressure gas chamber 1, FIG. 1. Xenon, other inert gases and their mixtures, including metal vapor, for example, mercury, and/or a variety of gas mixtures, including gas halides, may be contained in the chamber as a high-efficient plasma fuel. The focused second laser beam 11 of the second laser 17 is directed into the region intended for sustaining the radiating plasma 2. In the example of invention embodiment, the maximum radiation power in the second laser beam 11 may have a value of around $10^3$ Watts, while the laser pulse length may be around $10^{-4}$ s. During the radiation pulse of the second laser beam 11, the first laser beam 10 is generated, the focusing area of which at least partially superposes on the focusing area of the second laser beam. A short, less than 0.1 μs, and powerful, in the order of $10^4$ Watts or higher, radiation pulse of the first laser 16, whose energy is in the order of several mJ, is used to provide the optical breakdown with initial local gas ionization in a small volume with the characteristic size of 50 to 100 The second laser beam 11, whose energy and laser pulse length are many times higher than those of the first laser beam 10, is used to sustain the optical discharge at the power of laser radiation (in the order of $10^3$ W or more) which is many times higher than the radiation power in the beam 3 of the CW laser. Under sustaining the optical discharge by the second laser beam 11, the pulse length of which is around 100 μs or more, the plasma volume is increased due to its moving towards the laser beam 11 along the caustic and its radial expansion. So the plasma size of up to 1 mm can be achieved. Due to the sufficiently high (in the order of 0.1 J/pulse or higher) radiation pulse energy of the second laser beam 11, in the increased plasma volume a level of electron density is provided which is sufficient for reliable sustenance of the radiating plasma by the focused beam 3 of the CW laser 4 with a relatively small power not exceeding 300 Watts. Thus, the second laser beam provides a plasma density that is higher than the threshold plasma density of a continuous optical discharge having a value in the order of $10^{18}$ electrons/$cm^3$ or higher. In stationary mode, broadband radiation is output from the radiating plasma region 2 by at least one output beam 5 of the plasma radiation exiting through optically transparent part of the chamber 1 and intended for subsequent use.

Designing the light source as proposed above achieves reliable ignition of the continuous optical discharge without the use of igniting electrodes. This allows to significantly improve the chamber's design by simplifying its shape and eliminating mechanical stresses in the points where metal is hermetically introduced into the chamber, increasing the light source reliability and lifetime. Design simplification allows to use a chamber shape that reduces aberrations introduced into the output beam of plasma radiation exiting the chamber, and thereby increase the light source brightness. Also, it provides for the possibility to use chamber material with a higher transparency in the UV spectral range. Electromagnetic noise when starting the light source is reduced. Chamber lifetime is increased because metallization of its optically transparent parts is eliminated. Besides, absence of electrodes allows to significantly increase the spatial angle of radiation output and to raise the power in the output beam of plasma radiation. At the same time, elimination of igniting electrodes significantly reduces turbulence of convective flows inside the chamber, and, thereby, significantly increases the spatial and power stability of the laser-pumped plasma light source. Further improvement of stability is achieved due to the possibility of optimizing the dimensions of the electrodless chamber. In general, an increase of the light source brightness and stability is achieved, the possibility of raising its optical output in the UV range is realized, reliability and lifetime are increased, convenience of its operation is improved, and the operating costs are reduced.

Figure 3:
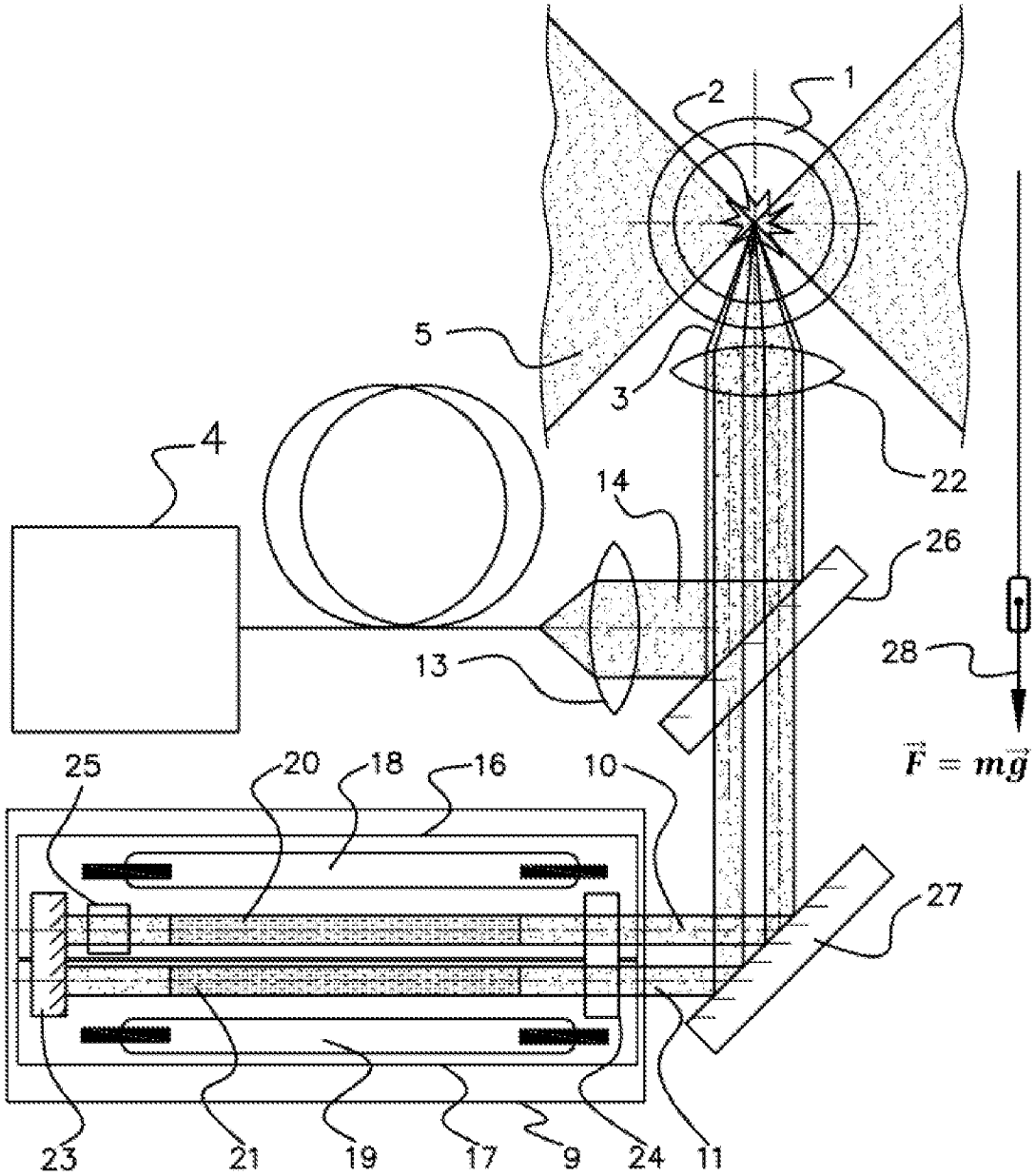

The above-mentioned possibilities are most easily realizable in a light source where the pulsed laser system 9 is a solid-state one, FIG. 3. In this embodiment of invention, the pulsed laser system 9 comprises two optically pumped solid-state lasers 16, 17. For example, flash lamps 18, 19 with reflectors can be used as sources of optical pumping. Lamps are switched on with an optimized delay relative to each other. Rods made of a transparent base material, for example, yttrium-aluminum garnet (YAG), doped with metal ions, for example, neodymium (Nd), can be used as the active elements 20, 21. The first and the second laser beams 10, 11 are preferably parallel and introduced into the chamber 1 via one common focusing optical system 22, for example, in the form of an aspherical condenser lens. To ensure that the laser beams 10, 11 are parallel, the first and the second solid-state lasers 16, 17 preferably have common cavity mirrors 23, 24. This provides superposition of the focusing areas of the first and the second laser beams 10, 11, required for plasma ignition.

In preferred embodiments of invention, the pulsed laser system 9 generates the first laser beam 10 in Q-switching mode or in giant-pulse generation mode, and the second laser beam 11 in free-running mode. In order to implement the Q-switching mode, the first laser is equipped with the Q-switch 25, for example, a passive one made of phototropic material. In another embodiment of the invention, an active Q-switching may be used.

Too high radiation power of the pulsed laser system 9 during giant pulse generation does not allow using optical fiber for transmitting its radiation, as the optical fiber can be damaged. Because of that, in the embodiments of invention only the CW laser is equipped with the fiber-optical output, FIG. 1, FIG. 3.

Preferably, the first and the second lasers 10, 11 have the same radiation wavelength, for example, $\lambda_1=\lambda_2=1.064$ μm, different from the wavelength of the CW laser $\lambda_{CW}$, for example, $\lambda_{CW}=0.808$ μm or 0.976 μm: $\lambda_{CW}\neq\lambda_1=\lambda_2$. This allows to use the dichroic mirror 26 for directing the expanded beam 14 of the CW laser to the chamber, FIG. 3.

To facilitate optical alignment and improve the light source configuration, the additional deflecting mirror 27 can be used in it, FIG. 3, or several such mirrors.

In embodiments of the invention, in the pathway of the CW laser beam 14, or in the pulsed laser system 9, additional optical elements (not shown) can be installed to offset chromatic aberrations and more accurately align the focusing areas of the CW and pulsed laser beams. In the pulsed laser system, in particular, inside the cavity formed by the mirrors 23, 24, additional optical elements, for example, polarizers, filters, diaphragms, can be installed to control parameters of the first and the second laser beams.

In the preferred embodiment of invention, the axis of the CW laser focused beam 3 is directed vertically upwards, i.e. against the force of gravity 28, FIG. 3, or close to vertical. The proposed design achieves the highest stability of the light source radiation power. This is due to the fact that usually the region of radiating plasma 2 is slightly moved from the focus towards the focused beam 3 of the CW laser up to the focused laser beam cross-section where the intensity of the focused beam 3 of the CW laser is still enough to sustain the radiating plasma region 2. When the focused beam 3 of the CW laser is directed from the bottom upwards, the radiating plasma region 2 that contains the hottest plasma with the lowest mass density, tends to float under the influence of the buoyant force. The rising region of radiating plasma 2 ends up in the location closest to the focus where the cross-section of the focused beam 3 of the CW laser is smaller, and the laser radiation intensity is higher. On the one hand, this increases the plasma radiation brightness, and on the other hand, it equalizes the forces acting on the radiating plasma region, which ensures high stability of the radiation power of the high-brightness laser-pumped plasma light source.

To realize these positive effects, preferably, the chamber 1 must be axisymmetric, and the axis of the focused beam 3 of the CW laser must be aligned with the chamber's axis of symmetry.

Besides providing highly stable output parameters, this invention realizes the possibility of achieving the highest brightness of laser-pumped broadband light sources, in particular, by means of optimizing the shape and dimensions of the electrode-free chamber. Correspondingly, in the preferred embodiments of invention, the external surface and the internal surface either of the chamber, or of its transparent parts, are shaped as concentric spheres, and the region of radiating plasma 2 is located in the center of the said concentric spheres, FIG. 3. In this embodiment of invention, aberrations introduced by the chamber walls are eliminated, making it possible to achieve a sharper focusing of the beam 3 of the CW laser and to increase the light source brightness. Also, aberrations that distort the path of rays in the beam 5 of output plasma radiation are eliminated, increasing its brightness.

Another positive outcome of the invention is the possibility of minimizing the chamber's dimensions. This increases the focusing sharpness of the CW laser beam 3 due to moving the focusing optical system 22 closer to the region of radiating plasma 2. Besides, the closer the region of radiating plasma to the walls of the chamber 1, in particular, to the top chamber wall, the smaller the pulse acquired under the action of the buoyant force, by the gas heated in the region of radiating plasma 2. Consequently, the speed and turbulence of gas convective flows are the smaller, the smaller the distance from the plasma to the chamber wall. Thus, the possibility is provided to further increase the brightness and stability of the laser-pumped plasma light source designed according to present invention.

To ensure plasma radiation output in a broad spectral range, from ultraviolet to near-infrared, the optically transparent parts of the chamber are preferably made of a material belonging to the group consisting of: crystalline magnesium fluoride ($MgF_2$), crystalline calcium fluoride ($CaF_2$), crystalline sapphire or leucosapphire ($Al_2O_3$), fused or crystalline quartz.

In the embodiment of invention, the chamber ensures that the output beam of plasma radiation 5 exits the chamber in a planar angle of $2\pi$ radians, without restriction to this option only FIG. 1, FIG. 3.

Figure 4:
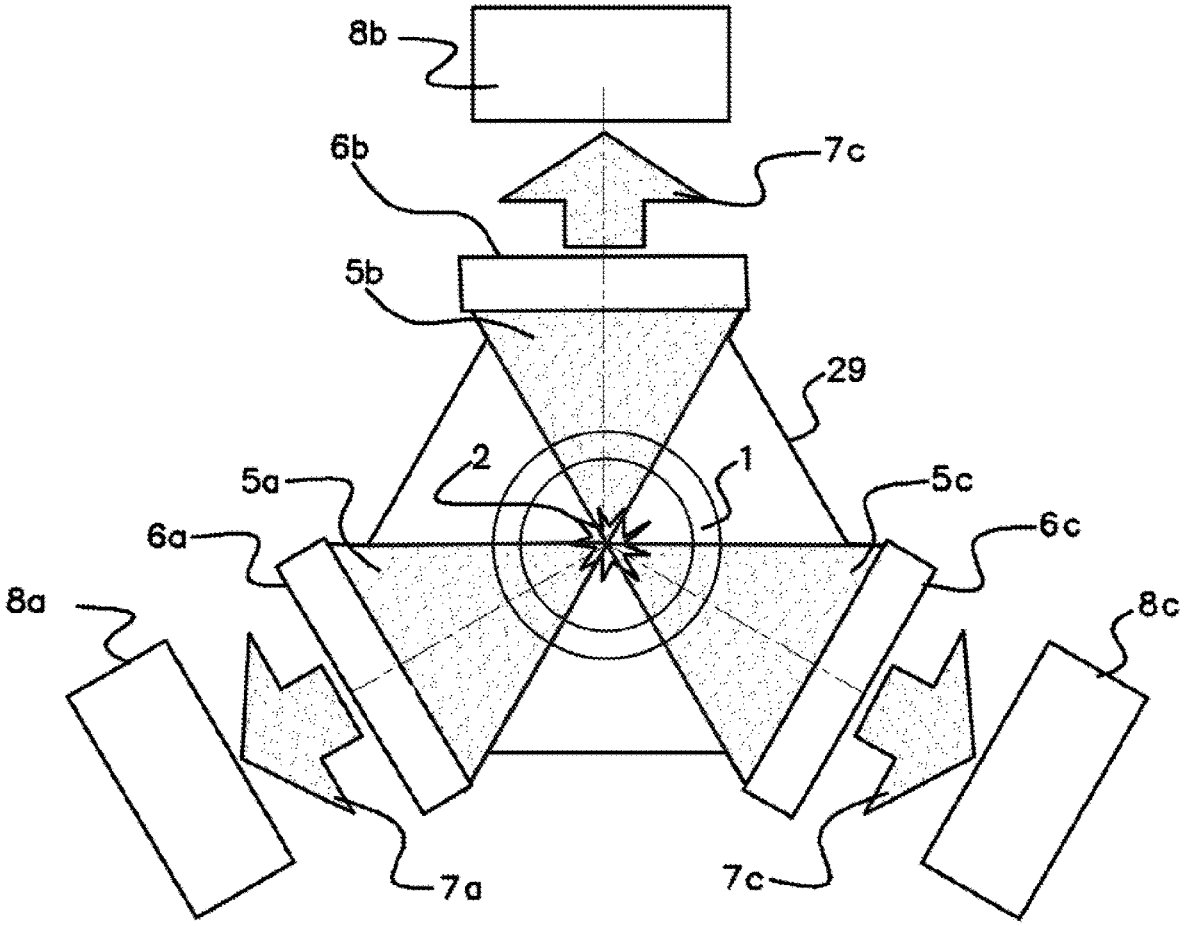

In another embodiment of invention, the light source can have at least three diverging output beams 5*a*, 5*b*, 5*c* of plasma radiation, as illustrated in FIG. 4, which shows the light source cross-section in the horizontal plane passing through the region of radiating plasma 2. The laser beams in FIG. 4, used for COD ignition and sustenance, are located below the plane of the drawing. Using several, in particular, three beams of plasma radiation from a single light source is required for a variety of industrial applications. In this embodiment of invention, the chamber 1 of the laser-pumped plasma light source is installed in the housing 29 which is equipped with three optical collectors 6*a*, 6*b*, 6*c*. The optical collectors 6*a*, 6*b*, 6*c* form the plasma radiation beams 7*a*, 7*b*, 7*c*, transmitted, for example, via an optical fiber to the optical consumer systems 8*a*, 8*b*, 8*c*, which use broadband plasma radiation. This allows to use one light source for three or more optical consumer systems resulting in compact size of the system and identical parameters of broadband radiation in all optical channels.

According to the invention, the method of plasma ignition in the laser-pumped plasma light source, illustrated in FIG. 1, FIG. 3, is as follows. The focused beam 3 of the CW laser 4 is directed into the high-pressure gas filled chamber 1, typically 10 atm or higher. The plasma ignition is provided by the pulsed laser system 9 generating the first and the second laser beams 10, 11 focused in the chamber. The first laser beam 10 is arranged to provide the optical breakdown, after which the second laser beam 11 is used to ignite the plasma, whose volume and density are sufficient for stationary plasma sustenance by the focused beam 3 of the CW laser 4.

In preferred embodiments of invention, the solid-state laser system is used, which generates the first laser beam 10 in Q-switching mode and generates the second laser beam 11 in free-running mode, FIG. 3. The pulsed laser system 9 preferably comprises two solid-state lasers 16, 17, for example, Nd:YAG lasers with optical pumping sources 18, 19 in the form of flash lamps. The first and the second laser beams 10, 11 are preferably parallel and introduced into the chamber 1 via the focusing optical system 22. To superpose the focus areas of the first and the second laser beams 10, 11, the solid-state lasers 16, 17 preferably have the common mirrors 23, 24 of the cavity. The first laser 16 is equipped with the Q-switch 25.

In the example of embodiment of invention Xe gas pressure in the chamber is 30 atm. The pulse energy, emitted by the first laser 16 in Q-switching mode, is 3 mJ with the pulse duration of 20 ns and laser wavelength of $\lambda_1$=1.064 μm. The optical breakdown plasma has a characteristic dimension of 50 to 100 μm. The optical breakdown mode does not provide reliable ignition of an optical discharge sustained by the focused beam 3 of the CW laser 4. Therefore, after optical breakdown the second laser beam is used to ignite the plasma, whose volume (up to 1 $mm^3$) and the density (over $10^{18}$ $cm^{-3}$) are sufficient for stationary plasma sustenance by the focused beam 3 of the CW laser 4. In the example of embodiment of invention, the energy of the second laser beam is 150 mJ, the pulse length is 100 μs, the laser wavelength is $\lambda_2$=1.064 μm.

Preferably, the radiation pulse of the second laser beam ends no earlier than 50 μs after the end of the first laser beam radiation pulse, as illustrated in FIG. 2. The time of at least 50 μs is necessary to allow for decay of disturbances from the optical breakdown and for the plasma dimensions and density evolving to the values sufficient for stationary plasma sustenance by the focused beam of the CW laser.

Figure 5:
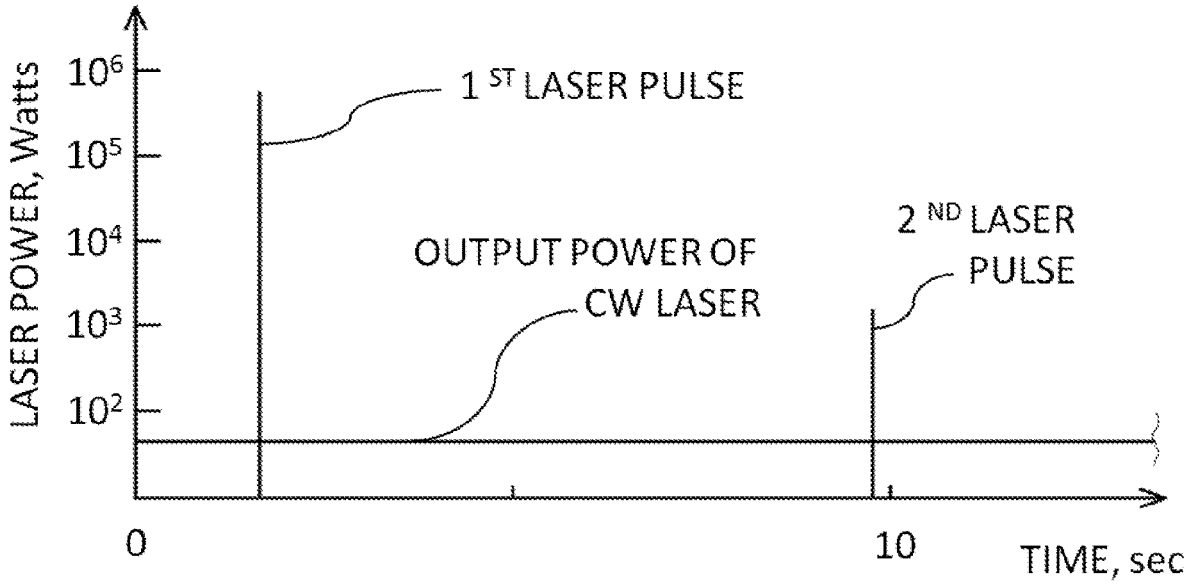

Generation of the second laser beam can start before the first laser pulse, FIG. 2. At the same time, the invention is not limited only to these embodiments. As demonstrated by the studies, COD ignition is also provided when the second laser beam is generated with a large, up to ten seconds or more, delay after the first laser beam generation, as illustrated in FIG. 5. The mechanism of such plasma ignition, probably, is connected to the influence of the giant pulse on the chamber walls, when long-lived clusters or solid fine particles are created as a result of this influence.

Generally, the proposed invention allows to ensure high reliability of laser igniting the laser-sustained plasma and to create high-brightness broadband light sources with the highest spatial and power stability on that basis.

INDUSTRIAL APPLICABILITY

High-brightness high-stability laser-pumped plasma light sources designed according to this invention can be used in a variety of projection systems, for spectrochemical analysis, spectral microanalysis of bioobjects in biology and medicine, microcapillary liquid chromatography, for inspection of the optical lithography process, for spectrophotometry and for other purposes.

What is claimed is:

1. A laser-pumped plasma light source, comprising: a gas filled chamber, at least a part of which is optically transparent; a region of radiating plasma sustained in the chamber by a focused beam of a continuous wave (CW) laser; at least one output beam of plasma radiation exiting the chamber, a means for plasma ignition characterized in that the means for plasma ignition is a pulsed laser system generating a first and a second laser beams focused in the chamber, whereas said first laser beam is arranged for a gas optical breakdown, and said second laser beam is arranged for plasma ignition after the optical breakdown.

2. The light source according to claim 1, wherein the first laser beam has a peak radiation power of more than $10^4$ Watts and a pulse length of less than 0.1 μs.

3. The light source according to claim 1, wherein the second laser beam has at least three times more laser pulse energy and at least an order of magnitude lower laser peak power compared to the first laser beam.

4. The light source according to claim 1, wherein the volume of the plasma ignited by the second laser beam many times, by an order of magnitude or more, exceeds the volume of the plasma created during optical breakdown by the first laser.

5. The light source according to claim 1, wherein the volume and density of the plasma ignited by the second laser beam are sufficient for stationary sustenance of the plasma by the focused beam of the CW laser.

6. The light source according to claim 1, wherein the second laser beam provides a plasma size of up to approximately 1 mm, and a plasma density of up to $10^{18}$ $cm^{-3}$ or more.

7. The light source according to claim 1, wherein the output power of the CW laser does not exceed 300 Watts.

8. The light source according to claim 1, wherein the radiation pulse of the second laser beam ends no earlier than 50 μs after the end of the radiation pulse of the first laser beam.

9. The light source according to claim 1, wherein the focusing areas of the first and the second laser beams at least partially overlap.

10. The light source according to claim 1, wherein the pulsed laser system comprises two lasers with common cavity mirrors, and wherein the first and the second laser beams are parallel and are introduced into the chamber through one common focusing optical system.

11. The light source according to claim 1, wherein the pulsed laser system is a solid-state laser system.

12. The light source according to claim 1, wherein the pulsed laser system generates the first laser beam in Q-switching mode or in giant-pulse generation mode.

13. The light source according to claim 1, wherein the pulsed laser system generates the second laser beam in free running mode.

14. The light source according to claim 1, wherein only the CW laser has a fiber-optic output.

15. The light source according to claim 1, wherein the wavelength of the CW laser is different from the wavelengths of radiation the first and the second laser beams.

16. The light source according to claim 1, wherein the axis of the focused beam of the CW laser is directed vertically upwards or close to vertical.

17. The light source according to claim 1, wherein the external surface and the internal surface of the chamber's transparent parts are shaped as concentric spheres or parts thereof, and the region of radiating plasma is located in the center of the said concentric spheres.

18. The light source according to claim 1, wherein the output beam of plasma radiation exits the chamber in all azimuths.

19. The light source according to claim 1, wherein the output beam of plasma radiation exits the chamber in a solid angle of not less than 9 sr.

20. The light source according to claim 1 with three or more output beams of plasma radiation.

21. A method for igniting plasma in a laser-pumped plasma light source comprising: direction of a focused beam of a CW laser into a chamber with high-pressure gas, plasma ignition and stationary sustenance of a radiating plasma by the focused beam of the CW laser, characterized in that the plasma ignition is provided by a pulsed laser system generating a first and a second laser beams focused in the chamber, whereas the first laser beam is used to provide an optical breakdown, after which the second laser beam is used to ignite the plasma, whose volume and density are sufficient for stationary plasma sustenance by the focused beam of the CW laser.

22. The method according to claim 21, wherein the pulsed laser system is a solid-state laser system which generates the first laser beam in Q-switching mode and generates the second laser beam in free-running mode.

* * * * *